United States Patent [19]

Lorenz et al.

[11] Patent Number: 4,832,795

[45] Date of Patent: May 23, 1989

[54] COKE DRY COOLING CHAMBER

[75] Inventors: Kurt Lorenz, Hattingen; Horst Dungs, Herne; Manfred Rudel, Bochum; Klaus-Dieter Kemper, Hamm, all of Fed. Rep. of Germany

[73] Assignee: Firma Carl Still GmbH & Co. KG, Fed. Rep. of Germany

[21] Appl. No.: 142,288

[22] Filed: Dec. 31, 1987

Related U.S. Application Data

[63] Continuation of Ser. No. 900,310, Aug. 25, 1986, abandoned.

[30] Foreign Application Priority Data

Aug. 30, 1985 [DE] Fed. Rep. of Germany ..... 3530984

[51] Int. Cl.[4] ..... C10B 39/02

[52] U.S. Cl. ..... 202/228; 165/134.1; 165/147; 201/39

[58] Field of Search ..... 202/227, 228, 267 R; 201/39; 165/134.1, 147; 122/7 R, 367 R; 34/167, 168

[56] References Cited

U.S. PATENT DOCUMENTS

| | | | |
|---|---|---|---|
| 921,878 | 5/1909 | Nutting | 122/367 R |
| 4,338,161 | 7/1982 | Weber et al. | 202/228 |
| 4,474,138 | 10/1984 | Remmers et al. | 202/228 X |

OTHER PUBLICATIONS

Dungs, Von H., *Technische Mitteilungen*, No. 9/1982, pp. 434–439.

*Primary Examiner*—David L. Lacey
*Assistant Examiner*—Joye L. Woodard
*Attorney, Agent, or Firm*—McGlew and Tuttle

[57] ABSTRACT

The invention relates to a coke dry cooling chamber with vertical outer walls constructed as cooling walls and parallel vertical cooling walls positioned in the cooling chamber, with supporting walls running crosswise to them. Pursuant to the invention, the cooling walls and supporting walls taper as they descend and the different coke cooling shafts created by them correspondingly broaden as they descend. A particular embodiment of the invention provides that diaphragm pipe walls constructed as cooling walls are equipped with flat outer abrasion plates. The space between the diaphragm walls, embodied in a pipe-stay-pipe construction, and the abrasion plates is filled with a highly heat-conductive material, graphite, for example.

4 Claims, 3 Drawing Sheets

COKE DRY COOLING CHAMBER

This application is a continuation of application Ser. No. 900,310, filed Aug. 25, 1986, now abandoned.

FIELD AND BACKGROUND OF THE INVENTION

The invention relates in general to coke ovens and in particular to a new and useful coke dry cooling chamber with vertical outer walls constructed as cooling walls and parallel vertical cooling walls positioned within the cooling chamber, with supporting walls running crosswise to them.

Coke dry cooling chambers are described in detail in *Technische Mitteilungen,* No. 9/1982, pp. 434–439. FIG. 3 on p. 435 shows the arrangement of the cooling walls in the coke shaft, the so-called diaphragm walls consisting of rows of pipes arranged vertically parallel to one another, the pipes being joined by stays. To get a good transfer of heat from the hot coke to the coolant in the pipes, the pipes are without facing. Now it has been shown that in long-term use of the coke dry cooling chamber over the course of years there is a certain amount of wear on the pipe walls, so that in extreme cases the pipe walls have to be replaced.

SUMMARY OF THE INVENTION

The invention provides a dry cooling chamber design that will completely avoid wear on the cooling pipes without substantial loss of heat conductivity and make it unnecessary to replace the pipes after years of operation.

To achieve this object, the invention provides that the cooling and/or supporting walls become narrower as they go down and the roughly rectangular coke cooling shafts formed by the cooling and supporting walls broaden out as they go down. Thanks to this tapered construction of the cooling and supporting walls in the cooling chamber the side pressure on the walls is substantially lessened, and the abrasion as the hot pieces of coke slide past these walls is also significantly diminished. While with the previous version the abrasion rate is around 0.4 mm per year, it can be reduced by about half by tapering. It is particularly helpful to have the widening of the coke cooling shafts as they descend be continuous, so that irregularities during the movement of the coke along the walls are avoided as much as possible and there are hence no spots subject to significantly higher wear.

The invention further provides that replaceable flat abrasion plates are positioned on the outside of the diaphragm pipe walls and that the space between the abrasion plates and the pipes or stays is filled with a highly heat conducting material. In this version the cooling walls are positioned in the cooling chamber vertical and completely flat, so that the hot coke can slide along the walls from top to bottom without significant abrasion. The abrasion plates, made of a metallic material, are highly heat-conducting in any case, and the space between the abrasion plates and the pipes, particularly in the area of the stays between the individual pipes, is filled not, for example, with a heat-insulating layer of air, but with a highly heat-conducting material. Surprisingly, it has been found that in spite of a slight reduction in the area of heat exchange and in spite of an increase in the wall thickness through which the heat must effectively pass, the transfer of heat to the cooling medium to be heated in the pipes is not notably impaired.

For the highly heat-conductive material, the invention proposes graphite or a heat-conducting concrete. With these, heat-conductivity can exceed 100 Watt/m and Kelvin. However, coke duff or dust and/or graphite dust that has been packed or compressed and/or treated with a bonding agent can also be used. The latter materials offer the advantage that they are partly products of the coking plant and can thus be economically obtained. These materials can be packed in on the spot after the pipes and abrasion plates have been assembled, in the remaining spaces, or may be installed as pre-formed components.

The abrasion plates on both sides of the diaphragm pipe walls are suitable connected together and held in place in front of the pipes by screws and/or tie rods. If necessary, individual abrasion plates can then be replaced.

Since the abrasion plates are mounted completely separate from the cooling pipes, they can be rendered somewhat tapered in the direction of the flow of the hot coke. This can be accomplished by making the interval between the abrasion plates and the diaphragm pipe wall larger at the top than at the bottom. The use of abrasion plates in conjunction with a highly heat-conductive intermediate layer, however, has the additional economic advantage that the pressurized pipeline system need no longer be designed with possible abrasion in mind. This embodiment thus no longer requires pipes with substantial wall thicknesses. Further, a high proportion of the weld seams with large cross-sections can be dispensed with.

Accordingly, it is an object of the invention to provide an improved dry cooling chamber for coke which includes an outer enclosure wall with a plurality of vertically elongated cooling walls within the enclosure wall arranged crosswise and intersecting with a plurality of vertically elongated supporting walls so as to define substantially rectangular cooling shafts there between which further includes either a cooling wall construction or a supporting wall construction which tapers inwardly and outwardly toward the lower ends.

A further object of the invention is to provide a dry cooling chamber construction with cooling walls constructed so that they substantially completely avoid wear of the cooling pipes which are carried by them without substantial loss of heat-conductivity.

A further object of the invention is to provide a dry cooling chamber for coke which is simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
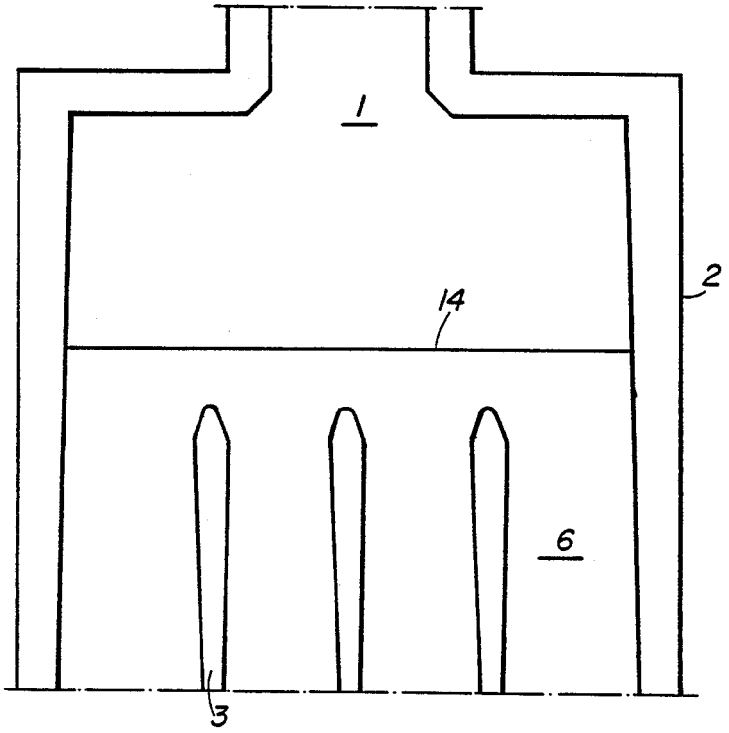
FIG. 1 is a schematic vertical sectional view of a portion of the cooling chamber constructed in accordance with the invention.

Referring to the drawings in particular the invention embodied therein comprises the dry cooling chamber for coke which is arranged with an outer enclosure walls 2 having a charger opening 1 in accordance with the invention the dry cooling chamber is made up of a plurality of vertically elongated cooling walls having fluid cooling tubes therein arranged transversely of a plurality of vertically elongated supporting walls extended transversely of and in between said cooling walls so as to define a substantially rectangular cooling shafts there between. In order to avoid damage and destruction to the cooling walls either the cooling walls 5 or the supporting walls 3 are formed so that they taper inwardly and downwardly toward the lower ends.

Figure 3:
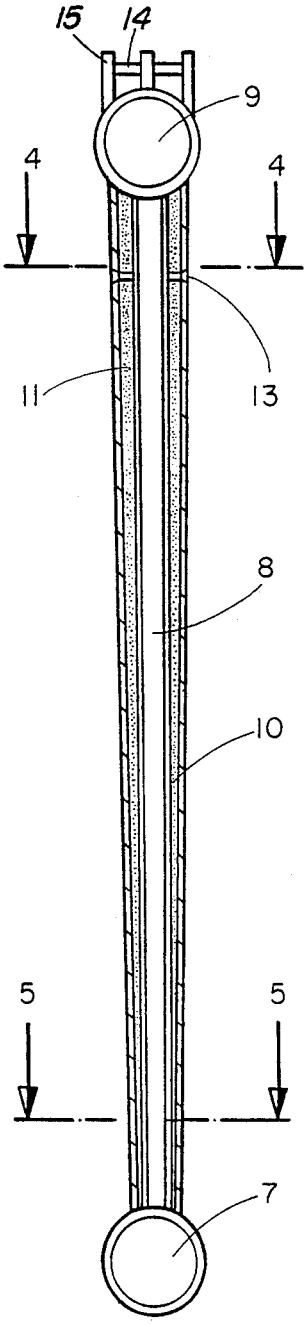
FIG. 3 is a cut-away vertical section of the diaphragm pipe walls.

In the schematic representation given in FIG. 1, the upper portion of a cooling chamber includes charging hole 1, outer walls 2 and internal supporting walls 3. At right angles to supporting walls 3 run internal cooling walls 5. The upper edges of the cooling walls 5 are designated in FIG. 1 as 14. As protection from the hot coke loaded in from above, both the supporting walls 3 and the cooling walls 5 have a rounded abrasion layer on their upper side. As indicated in FIG. 3, the upper edge 14 can also be a more or less flat surface on which pieces of coke come to rest, constituting an abrasion protection layer of a sort. At the same time, the vertical side abrasion plates 10 project upwardly with an abrasion edge or tip 15.

Figure 2:
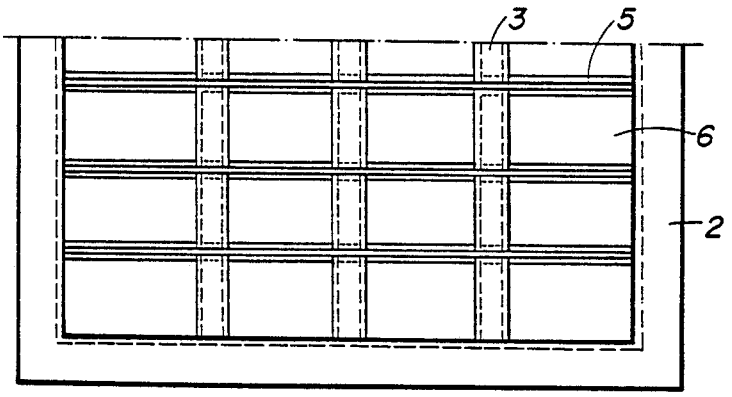
FIG. 2 is a horizontal section taken along line 2—2 of FIG. 1.
Figure 4:
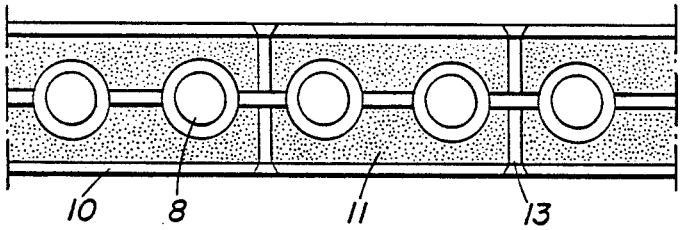
FIG. 4 is a section taken along line 4—4 of FIG. 3.
Figure 5:
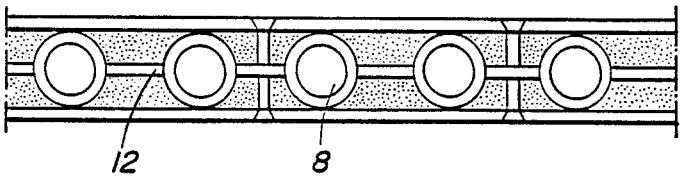
FIG. 5 is a section taken along line 5—5 of FIG. 3.

FIG. 1 also shows the taper of the outer and inner walls of the cooling chamber and the consequent broadening of the coke cooling shafts 6 toward the bottom. FIG. 2 shows the arrangement of the supporting and cooling walls 3 and 5 in the cooling chamber. FIGS. 3 through 5 depict the construction of the individual diaphragm pipe walls 5 with the coolant distributor or conduit 7 at the bottom, the coolant pipes 8 extending vertically and the collector 9 at the top. On the sides of the cooling walls 5 in contact with the coke, abrasion plates 10 are mounted that are held in front of the pipes and the highly heat-conductive material 11 by means of fastening elements or bolts 13 which may also extend through stays 12. To achieve the tapering called for by the invention, the layer of highly heat-conductive material 11 positioned between the pipes and the abrasion plates can be of variable thickness, i.e., the thickness diminishes from top to bottom.

While specific embodiments of the invention have been shown and described in detail to illustrate the application of the principles of the invention, it will be understood that the invention may be embodied otherwise without departing from such principles.

What is claimed is:

1. A dry cooling chamber for coke, comprising: an outer enclosure wall defining a vertically elongated chamber; a plurality of vertically elongated cooling walls extending across the chamber defined by the enclosure wall, each of the vertically elongated cooling walls including an outer surface formed of abrasion plates, a plurality of water cooled pipes positioned within said abrasion plates and a layer of prefabricated highly heat-conductive material disposed between said abrasion plates and said pipes, said layer tapering inwardly and downwardly from an upper end of the cooling wall to a lower end thereof; a plurality of vertically elongated supporting walls extending transversely of and in between said cooling walls and defining with said cooling walls rectangular cooling shafts extending vertically therebetween widening in a downward direction.

2. A dry cooling chamber for coke according to claim 1 wherein said heat-conductive material comprises a graphite or a heat-conducting concrete.

3. A cooling chamber according to claim 1 wherein said prefabricated highly heat-conducting material comprises a packed coke dust compressed and treated with a bonding agent.

4. A dry cooling chamber for coke, comprising: an outer enclosure wall defining a vertically elongated chamber; a plurality of vertically elongated cooling walls extending across the chamber defined by the enclosure wall, each of said cooling walls including an outer surface formed of abrasion plates; a plurality of pipes for circulating liquid coolant positioned inside said abrasion plates extending vertically from an upper distribution conduit to a lower distribution conduit; a layer of prefabricated, highly heat-conductive material disposed between said abrasion plates and said pipes; transversely extending stays extending between said pipes; fasteners extending transversely of said stays and connected to the abrasion plates; a plurality of vertically elongated supporting walls extending transversely of and in between said cooling walls and defining with each of said cooling walls a plurality of rectangular cooling shafts extending vertically therebetween, at least one of said layer of highly heat-conductive material tapering inwardly and downwardly from said upper distribution conduit to said lower distribution conduit or said supporting walls tapering inwardly and downwardly from an upper end of said supporting wall to a lower end thereof, whereby each of said rectangular cooling shafts widens in a downward direction.

* * * * *